US005608915A

United States Patent [19]

Libit

[11] Patent Number: 5,608,915

[45] Date of Patent: Mar. 11, 1997

[54] COMBINATION GARMENT WITH DETACHABLE TORSO AND LEG ENCLOSING COMPONENTS

[76] Inventor: Jeanne E. Libit, 2322 N. Upton St., Arlington, Va. 22207

[21] Appl. No.: 493,704

[22] Filed: Jun. 22, 1995

[51] Int. Cl.[6] ..... A41D 17/00; A41D 1/06

[52] U.S. Cl. ..... 2/228; 2/240; 2/79

[58] Field of Search ..... 2/228, 240, 311, 2/269, 914, 919, 920

[56] References Cited

U.S. PATENT DOCUMENTS

| | | | |
|---|---|---|---|
| 269,479 | 12/1882 | Stretch et al. | 2/228 X |
| 1,970,129 | 8/1934 | DeMartinez | 2/240 X |
| 3,511,245 | 5/1970 | Jaggers | 2/240 X |
| 4,766,613 | 8/1988 | Wells | 2/269 X |
| 4,811,427 | 3/1989 | Regan | 2/919 X |
| 4,985,936 | 1/1991 | Jones | 2/269 |
| 5,182,812 | 2/1993 | Goldsby | 2/914 X |

*Primary Examiner*—C. D. Crowder
*Assistant Examiner*—Shirra L. Jenkins
*Attorney, Agent, or Firm*—Jacobson, Price, Holman & Stern, PLLC

[57] ABSTRACT

A combination garment constructed of stretch material including a torso portion to snugly engage and enclose the lower torso of a wearer and at least a portion of the thighs or upper leg portions of a wearer and a pair of leg portions engaging and enclosing the remainder of the legs of a wearer. Coacting connecting structures are provided on the upper end of the leg portions and the lower ends of the portions of the torso portion that engages and encloses the thighs or upper leg portions of a wearer for attaching and detaching the leg portions in relation to the torso portion.

6 Claims, 1 Drawing Sheet

FIG. 1
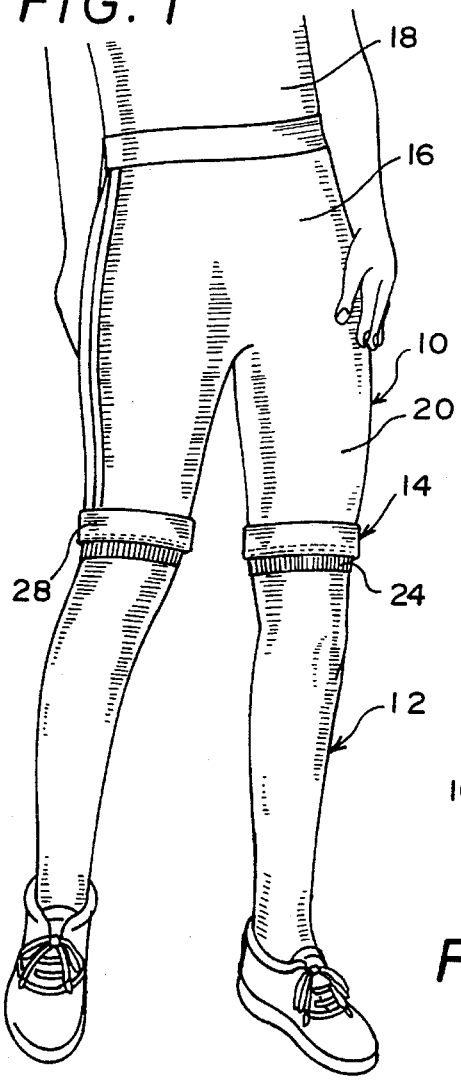
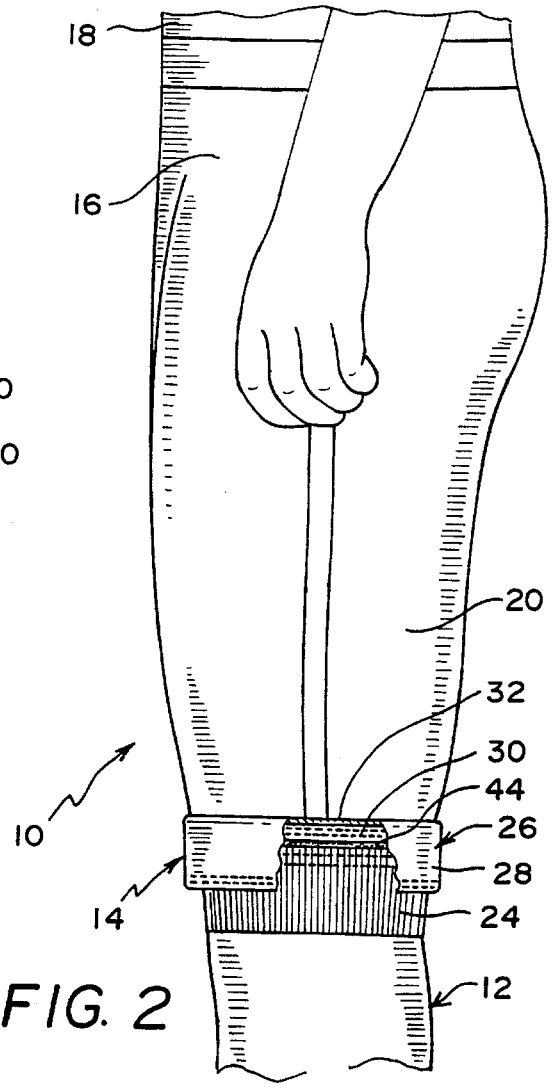
FIG. 2
FIG. 3
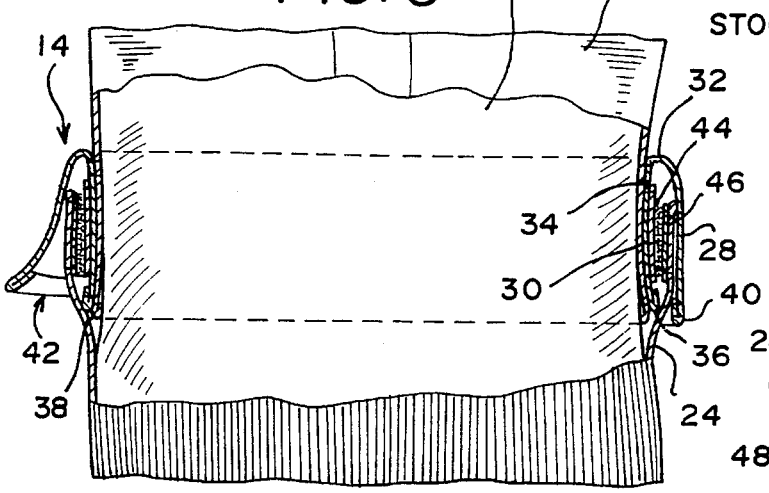
FIG. 4
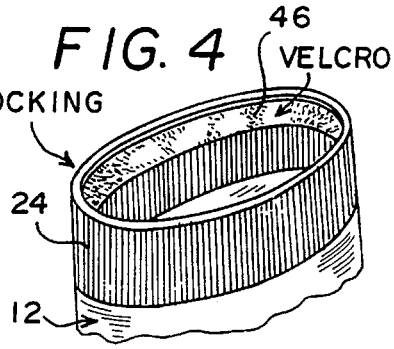
FIG. 5
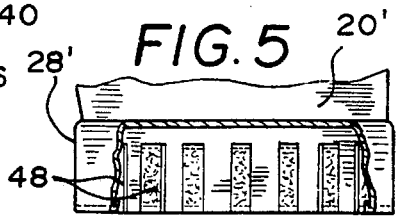

COMBINATION GARMENT WITH DETACHABLE TORSO AND LEG ENCLOSING COMPONENTS

BACKGROUND OF THE INVENTION

1. Field of the Invention

The present invention generally relates to garment structures including the combination of a lower torso covering and enclosing portion, leg or other extremity covering and enclosing portions and a releasable connection between the portions of the garment to enable separation and connection between the portions. More specifically, the lower torso covering and enclosing portion is a shorts type garment constructed of stretch material to snugly engage and enclose the lower torso of a wearer and leg portions which enclose a substantial portion of the thighs or upper leg portions of a wearer. The leg covering and enclosing portion is in the form of stockings, leggings, tights, leg warmers or the like. The leg portions of the shorts type garment includes connecting structure at the lower end thereof and coacting connecting structure is provided on the upper end of the leg covering and enclosing portion for attaching and detaching the leg covering enclosing portion in relation to the shorts type garment.

2. Description of the Prior Art

Various garments have been developed for use by individuals engaged in various activities including exercise routines, dance regimens and athletic events. One such garment is a shorts type garment constructed of stretch material of cotton or other acceptable fabrics. The shorts type garments constructed of stretch material enclose the lower torso region of a wearer and include depending leg portions which cover the thighs of a wearer with the lower end of the legs of the shorts type garment terminating adjacent to but above the knees. This type of shorts garment has been found acceptable to individuals engaged in various exercises including walking, running, jogging, bicycle riding and the like.

Pantyhose are frequently worn by women engaged in office work, during social events where a dress or skirt is proper attire. However, pantyhose are difficult to put on, constrict body movement as they are a tights like garment which grip around the waist and crotch, tend to stretch and bag or sag, subject to "runs" occurring in the knit material, relatively cold during cold temperature conditions, relatively hot during hot temperature conditions and difficult to remove. Also, pantyhose are sometimes ill fitting because they are usually available in a "few sizes fit all" in which a few particular sizes can supposedly fit a woman who is 5'7" tall and weighs 130 lbs. as well as a woman who is 5'2" tall and weighs 140 lbs. The physical characteristics of womens bodies do not conform to two or three distinct sizes which are commercially available. Thus, the pantyhose may sag or bag because they are too big or are tight and/or short because they are too small.

There are other products available which provide a sheer covering for the legs of women wearing a skirt or dress such as knee high and thigh high stockings which incorporate an elasticized cuff at the upper end. These products provide a better fit than pantyhose as they do not attempt to stretch over the abdomen and buttocks to stay up. Rather, these products snugly surround and "grab" the upper calf of the leg or the thigh area above the knee. When the elasticized cuff weakens or fails to "grab" the leg or thigh, the stocking may fall downwardly on the leg which can cause great embarrassment. The nylon thread used in pantyhose, stockings, leggings, tights and the like can be rough and cut into the flesh, especially in the soft areas of the thighs and waistline area, which can result in skin irritation and discomfort.

SUMMARY OF THE INVENTION

An object of the present invention is to provide a combination shorts type garment constructed of stretch material, leg covering members and an effective separable connection between the lower ends of the legs of the shorts type garment and the upper end of the leg covering members which provides a more comfortable combination garment as compared to pantyhose by enabling the wearer to use a shorts type garment which is a better fit and leg covering members which are a better fit.

Another object of the invention is to provide a combination garment as defined in the preceding object which allows versatility such as when a person wears nylon hose in one environment, such as at work, and removes the nylon hose or stockings and quickly switching to socks for the commute home. This provides various alternative or choices for the wearer of the combination garment.

An additional object of the invention is to provide a combination garment as set forth in the preceding object in which the connection between the legs of the shorts type garment and the upper ends of the leg covering members is coacting hook and loop pile material available under the registered trademark "VELCRO" on the lower end of the legs of the shorts type garment and the upper ends of the leg covering members.

A further object of the invention is to provide a connection between the upper ends of leg covering members and the lower ends of legs of a shorts type garment in which the legs of the shorts type garment have a narrow peripheral cuff on the outer surface thereof with the cuff being attached to the leg of the shorts type garment with its lower edge being free of the legs of the shorts type garment and extending into overlapping relation to the upper end portion of the leg covering member in order to conceal and cover the connection between the legs of the shorts type garment and the upper ends of the leg covering members.

Still another object of the invention is to provide a combination garment as described in the preceding objects in which the "VELCRO" is in the form of strips of "VELCRO" on the upper end of the leg covering member being mounted on the inner surface of the leg covering member and is the hook type component of the "VELCRO".

Yet another object of the invention is to provide a combination garment as described in the preceding objects in which the legs of the shorts type garment are each provided with an inner cuff attached to the leg of the garment with the inner cuff having the loop type component of "VELCRO" mounted thereon in outwardly facing relation for cooperation with the inwardly facing "VELCRO" component in the upper end of the leg covering member.

This arrangement provides a combination garment that is more comfortable than the combination of a stretch type shorts garment and pantyhose and more comfortable than pantyhose when worn with a skirt or dress and more effective to retain other leg covering members such as knee high stockings, thigh high stockings, tights, leg warmers, leggings and the like which engage the outer surface of the entire length of the legs. The combination garment is easy to place in position and remove by enabling the shorts type garment to be put on after which the stockings or other leg covering members are put on and connected to the shorts type garment. Ease of removal is obtained by disconnecting the stockings or other leg covering members from the shorts type garment to enable independent removal.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the lower torso and legs of a wearer illustrating the combination shorts type garment and stockings in assembled relation.

FIG. 2 is a side elevational view of the assembly illustrated in FIG. 1, with portions broken away, illustrating the cuff arrangement and the connection between the lower end of the shorts type garment leg and the upper end of the stocking.

FIG. 3 is a vertical sectional view, on an enlarged scale illustrating the construction of the cuff arrangement and connecting arrangement between the shorts type garment and the stocking.

FIG. 4 is a perspective view of the upper end of a stocking illustrating the "VELCRO" strip attached to the inner surface thereof.

FIG. 5 is a perspective view of the lower end of a garment leg illustrating circumferentially spaced strips of "VELCRO" attached thereto.

DESCRIPTION OF A PREFERRED EMBODIMENT

Referring now to the drawings, the combination garment of this invention includes a shorts type garment generally designated by reference numeral 10, leg covering and enclosing stockings 12 and a unique separable connection 14 to enable connection of the stocking 12 with the shorts type garment 10.

The shorts type garment 10 includes a body portion 16 enclosing and snugly engaging the lower torso area of a wearer 18 with the body portion 16 including depending legs 20 which enclose and snugly embrace the lower portion of the thigh designated by reference numeral 22 to a point adjacent to but spaced above the knee of a wearer or the legs 20 may extend downwardly to positions below the knee if desired. The shorts type garment is preferably constructed of stretch material and is conventional except for the unique connection 14 at the lower end of each leg 20. The shorts type garment 10 is constructed of stretch cotton or other material such as that available under the trademark "LYCRA".

The stockings are preferable knit stockings of sheer material such as nylon or the like with the upper end of the stocking 12 being designated by reference numeral 24 with the upper end thereof being reinforced and resilient to engage the leg surface of the wearer. The length of the stockings 12 is such that it extends above the knee or to the necessary height to be connected to the shorts type garment legs 20 by the connection 14.

While the shorts type garment 10 is disclosed of stretch material and the stockings 12 are disclosed of sheer material, it is pointed out that various types of shorts type garments may be used and leg covering members of materials other than sheer material may be used to form the combination garment.

The details of the connection 14 are illustrated in FIG. 3 and includes a cuff assembly generally designated by numeral 26 and which includes an outer cuff 28 and an inner cuff 30 connected at their upper ends by a reverse bend 32. The cuff assembly 26 is of one piece fabric material with the inner cuff 30 being attached to the lower end of the leg 20 by stitching 34. The lower edge of the inner cuff 30 is provided with a hem 36 at its lower edge which is oriented slightly above the hem 38 and the lower end of the leg 20. The lower end edge of the outer cuff 28 is provided with an inturned hem 40 which is positioned slightly below the hem 36 and the hem 38 thus defining a downwardly facing open area 42 between the hem 40 and the hems 36 and 38 to enable the upper end of the stocking 12 to be oriented between the outer cuff 28 and the inner cuff 30.

The external surface of the inner cuff 30 is provided with a continuous circumferentially extending strip 44 of the loop component of "VELCRO" fastening material so that the loops face outwardly. The strip of loop fasteners 44 is secured to the inner cuff 30 by stitching or other conventional fastening means. As shown in FIG. 4, the interior surface of the upper end of the stocking 12 is provided with a continuous circumferentially extending strip 46 of the hook component of "VELCRO" fastening material which is secured to the interior of the stocking by stitching or other conventional fastening means. The hook type strip 46 is inwardly facing and when the upper end of the stocking 12 is oriented in overlying concentric relation to the loop type strip 44, inward circumferential pressure exerted on the external surface of the outside of the stocking or the external surface of the cuff will assure secure attachment of the upper end of the stocking to the leg of the shorts type garment. This connection assures that the stockings are retained in a position to enable unrestricted movement of the muscles and body components but yet will not sag or become baggy during various normal body movement. Also, this arrangement provides a comfort level substantially greater than the combination of a short type garment with underlying pantyhose. Further, this arrangement enables the combination garment to be more easily assembled since the shorts type garment 10 can be placed in position independently of the stockings 12 and the stockings 12 subsequentially placed in position and the connection made between the stockings and the legs of the shorts type garment. Likewise, when removing the stockings, it is a simple matter to move the outer cuff upwardly to expose the upper end of the stocking and detach the "VELCRO" strips to easily remove the stockings and then easily remove the shorts type garment if desired. The outer cuff conceals the connection between the stockings and legs of the shorts type garment to provide a neatness in appearance with the combination of the shorts type garment and stockings of this invention being substantially more comfortable than when using pantyhose in combination with a shorts type garment of the stretch type.

As shown in FIG. 5, the cuff 28 on each leg 20' of garment 10 can be provided with vertical strips 48 of the loop component of "VELCRO" rather than a continuous strip 44 as in FIGS. 2 and 3. This arrangement enables the vertical adjustment if the stocking or legging begins to bag or is too short. The use of spaced vertical strips of "VELCRO" around the bottom end of the pants legs of the garment provides a more flexible and more comfortable garment as compared to the continuous strip which, in some instances, is too stiff and uncomfortable. Likewise, the continuous strip of "VELCRO" on the stocking 12 can be a plurality of spaced circumferentially strips to enhance the flexibility of the upper end of the stocking. The hook component and loop component of "VELCRO" may be oriented on either the cuff 30 or the leg of the garment or on the stocking 12.

This combination garment provides a comfortable, versatile, and better fitting garment. The combination garment of this invention is more comfortable and better fitting because the shorts type garment can be sized correctly independently of the stockings or hose. This combination garment of this invention is more versatile as it enables a wearer to wear stockings or hose attached to the short type garment and when desired, the stockings or hose can be detached and removed and replaced with socks or other leg coverings. For example, in cold or inclement weather conditions, a leg warmer type leg covering can be connected to the shorts type garment to protect the legs against cold temperatures or wet conditions better than sheer nylon hose. The combination sports type garment of this invention also saves money as it enables more expensive sheer nylon hose to be replaced with less expensive socks when commuting or the like thereby not exposing the sheet nylon hose to snags, runs or other hazards that may be encountered when commuting or other activities where the appearance characteristics of the hose are not essential.

This concept can also be incorporated into doll structures to facilitate the assembly of shorts type garments and stockings, constructed to the scale of a doll, on the doll and also enable easy removal of the miniature garments.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A shorts type garment constructed of fabric material enclosing the lower torso region of a wearer and including depending legs covering upper end portions of the legs of a wearer to a point adjacent the knees, a leg covering member covering each of the legs of a wearer below the legs of the garment and coacting fasteners on lower ends of the legs of the garment and upper ends of the leg covering members detachably connecting the lower ends of the legs of the garment and the upper ends of the leg covering members, said shorts type garment being constructed of stretch material snugly engaging the anatomical surfaces enclosed by the garment, said leg covering members being constructed of fabric material covering the anatomical surfaces enclosed by said leg covering members, said coacting fasteners including areas of hook and loop pile fastener material oriented peripherally of the lower end of each leg of the garment and the upper end of each leg enclosing member, the areas of fastener material on the leg enclosing member being on the interior surface thereof and the areas of fastener material on the leg of the garment being on the exterior surface thereof, the exterior surface of each of said depending legs including an inner fabric cuff and an outer fabric cuff mounted thereon, a reverse bend of fabric joining said cuffs along a top edge thereof, said areas of fastener material on the leg being secured to the external surface of the inner cuff and concealed by the outer cuff, said inner and outer cuffs having bottom edges that are unconnected to provide a downwardly facing circumferential opening to enable the upper end of the leg enclosing member to be received between the inner cuff and outer cuff for engagement of the areas of fastener material on the interior surface of the leg enclosing member with the areas of fastener material on the external surface of the inner cuff.

2. The garment as defined in claim 1 wherein said inner and outer cuffs are of flexible fabric material with the inner cuff being attached to the leg of the garment by stitching thus enabling the outer cuff to be moved to a position exposing the upper end of the leg enclosing member when it is desired to attach or detach the leg enclosing member from the leg of the garment.

3. The garment as defined in claim 2 wherein said areas of fastener material on the inner cuff is the loop pile fastener material and is in the form of circumferentially spaced vertical strips to enable vertical adjustment of the upper end of the leg enclosing member in the event the leg enclosing member bags or is too short and to provide flexibility to the cuff.

4. The garment as defined in claim 2 wherein the areas of fastener material on the inner cuff is the loop pile fastener material and is in the form of a peripherally continuous strip and the areas of fastener on the inner surface of the leg enclosing member is the hook pile fastener material and is in the form of a peripherally continuous strip.

5. The garment as defined in claim 2 wherein said leg enclosing members are knit sheer material provided with a reinforced area circumferentially at the upper end thereof, said areas of fastener material enabling the shorts type garment and leg enclosing members to be placed in position on the wearer and removed from the wearer independently of each other.

6. The garment as defined in claim 2 wherein said torso enclosing region and leg covering members are in the form of pantyhose of sheer material, said coacting fasteners enabling the torso enclosing region to be pulled into position without pulling the leg covering members into position at the same time and enabling vertical adjustment of the upper ends of the leg enclosing members in relation to the lower ends of the legs of the torso enclosing region.

* * * * *